US005118321A

United States Patent [19]

Greenberg et al.

[11] Patent Number: 5,118,321

[45] Date of Patent: Jun. 2, 1992

[54] SIMULATED FEEDING APPARATUS

[75] Inventors: Lawrence J. Greenberg, New Rochelle; Gregory E. Hyman, Pound Ridge; Judith H. Blau, Eastchester, all of N.Y.

[73] Assignee: Kenner Products, Division of Tonka Corp., Cincinnati, Ohio

[21] Appl. No.: 771,407

[22] Filed: Oct. 2, 1991

[51] Int. Cl.[5] ..... A63H 3/00

[52] U.S. Cl. ..... 446/304; 446/486; 446/489; 472/71

[58] Field of Search ..... 446/304, 305, 479, 486, 446/489, 491, 268; 272/8 R, 8 N

[56] References Cited

U.S. PATENT DOCUMENTS 3,008,267 11/1961 Scheider ..... 446/304

4,159,594 7/1979 Reiner et al. ..... 446/304 X 4,508,521 4/1985 Klimpert et al. ..... 446/486

*Primary Examiner*—Mickey Yu

*Attorney, Agent, or Firm*—Darby & Darby

[57] ABSTRACT

A utensil which has a feeding end and a hollow handle. A holding element is displaceable within the hollow element relative to the feeding end between a revealing position, where an end of the holding element that is decorated with imitation food projects over the feeding end, and a hidden position, where the decorated end of the holding element is withdrawn and concealed within the hollow handle. A spring biases the holding element into the hidden position and a latch retains the holding element in the revealing position. The holding element enters the revealing position during withdrawal of the utensil from a toy container and enters the hidden position during insertion of the feeding end into a doll's mouth.

10 Claims, 2 Drawing Sheets

SIMULATED FEEDING APPARATUS

BACKGROUND OF THE INVENTION

1. Field of the Invention

The present invention relates to a simulated feeding apparatus for simulating the feeding of food to a doll with a utensil such as a spoon. The food appears to disappear from the utensil during insertion into the doll's mouth. The utensil appears to refill when withdrawn from a container, which appears to contain the same type of food.

2. Discussion of Related Art

U.S. Pat. No. 4,159,594, whose contents are incorporated herein by reference, discloses a simulated feeding device in which imitation food seems to disappear from a spoon when brought to a doll's mouth or seems to be refilled when inserted into a container of the imitation food. In order to achieve this effect of disappearance or refill of the imitation food, magnets are employed.

One magnet is located near the mouth of the doll. The other magnet is in the container. The spoon itself has a magnet secured to the underside of a rotatable plate in the spoon bowl. One half of the plate holds imitation food and the other exhibits a false bottom for the spoon. A magnet at the underside of the plate has a north polarity beneath the false bottom and a south polarity beneath the imitation food. Half the spoon bowl is enclosed by a cover.

Thus, when the spoon is brought near the mouth of the doll, the south polarity of the magnet in the doll and also in the spoon repulse each other so that the plate rotates to make the false bottom become visible in the spoon bowl and to conceal the food beneath the cover of the spoon. When the spoon is brought near the north polarity of the magnet in the container, the north polarity of the magnet in the spoon repulses, causing the plate to rotate so that the food becomes visible and the false bottom becomes hidden beneath the cover of the spoon.

Thus, the illusion that the doll is being fed with food and that the spoon is being filled with food from the container is realized. A weak magnetic insert is added to the spoon to retain the plate in its rotated position and thereby avoid undesired turning when the spoon is moved.

It would be desirable to avoid using a false bottom and to avoid using a cover to hide half the bowl of the spoon. In this manner, the spoon bowl will look more like a normal spoon bowl, which does not have to be as round or as deep as a bowl with a false bottom and which has no cover to hide half of it. It would also be desirable to avoid the necessity for a plurality of magnets and to be able to avoid the unrealistic appearance of the "food" on the spoon rotating out of the way when the spoon approaches the month of the doll.

SUMMARY OF THE INVENTION

The present invention resides in an apparatus for simulating the feeding of food to the mouth of a baby doll. It includes a toy utensil having a feeding end and having a hollow handle which extends from the feeding end. An elongated holding element with an end for holding imitation food is displaceable along the toy spoon between two positions. The first position is a hidden position in which the end of the holding element with the imitation food is concealed within the hollow handle and the second position is a revealing position in which the end of the holding element with the imitation food is visible over the feeding end of the utensil. A spring is provided to bias the holding element into the hidden position. A latch is provided to releasably secure the holding element in the revealing position.

The present invention is also directed to a mechanism for securing the latch when the holding element is in the revealing position. A container has an opening through which the toy utensil may be inserted in only one relative orientation. A projection extends into the opening from the container and into a guide track of the toy utensil for guiding the same during insertion and withdrawal of the toy utensil from the container. The holding element has a protrusion which bears against the projection during withdrawal of the toy utensil from the container. During withdrawal, the handle and feeding end move relative to the holding element, which is being retained by the protrusion acting against the projection. This relative movement is in opposition to the biasing force of the spring, which is attached between the other end of the holding element and the handle. Thus, the end of the holding element with the imitation food is displaced to a position above the feeding end of the utensil.

After the end of the holding element with the imitation food has been displaced over the feeding end as far as the relative movement allows, a latch of the utensil is cleared by a catch from the holding element. The catch is biased to engage the latch as soon as it clears it so as to hold the holding element in revealing position.

The surfaces of the projection and protrusion are such that the protrusion slides along the projection during further withdrawal of the toy utensil (that is, after the latching engagement has taken place) until the protrusion has cleared the projection. Continued withdrawal of the toy utensil will eventually lead to removal of the entire toy utensil from the container and gives the appearance that the feeding end of the toy utensil contains food.

The feeding end is the brought to a doll's mouth, where a protruding portion of the imitation food is squeezed between the lips of the doll, which causes the latch to release. Since the holding element is spring loaded, the holding element is pulled by the spring into the hollow handle, thereby bringing the imitation food with it for concealment into the hidden position.

BRIEF DESCRIPTION OF THE DRAWINGS:

For a better understanding of the present invention, reference is made to the following description and accompanying drawings, while the scope of the invention is set forth in the appended claims.

DESCRIPTION OF THE PREFERRED EMBODIMENT

Figure 1:
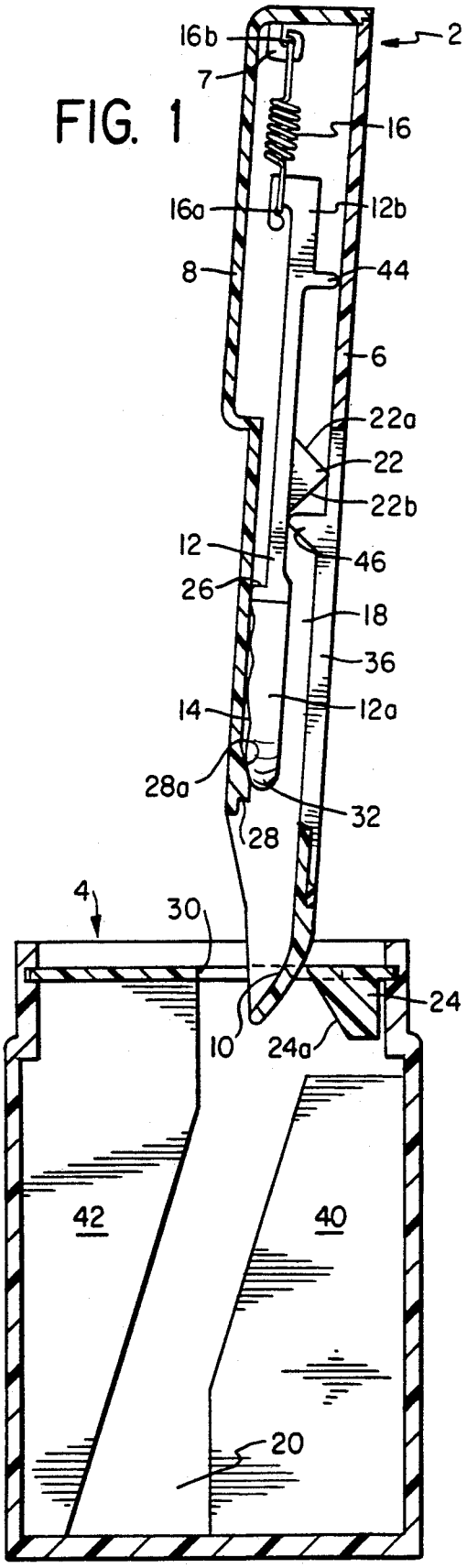
FIG. 1 is an elevational cross-section of the container and spoon in accordance with the present invention. The imitation food is in a hidden position within the hollow of the spoon. The spoon is about to be inserted into the container.
Figure 2:
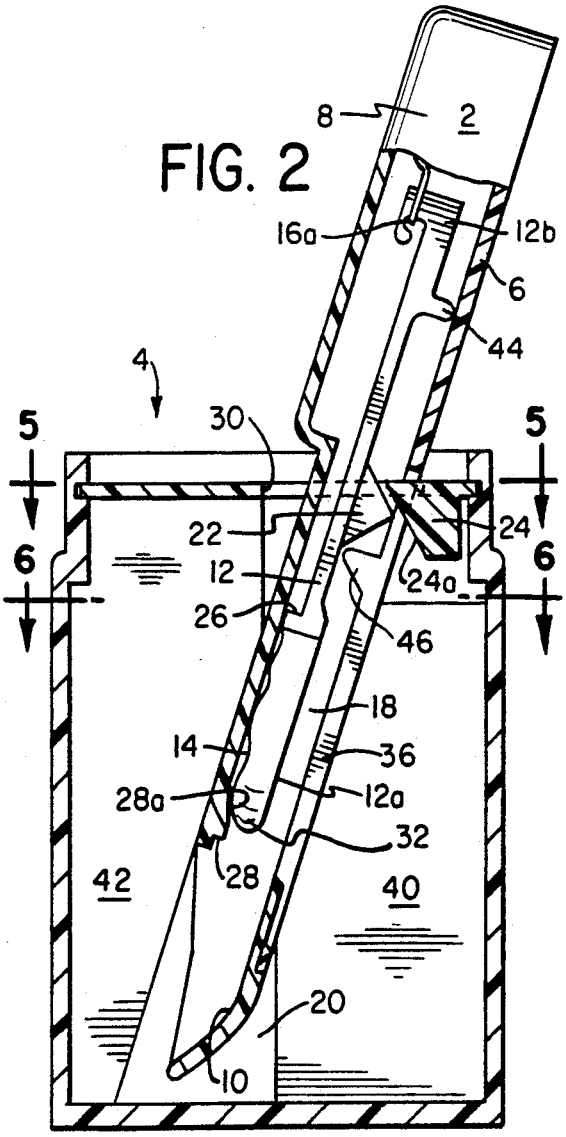
FIG. 2 is an elevational cross-section of the container and spoon of FIG. 1 showing the relationship of the parts after the spoon has been fully inserted into the container.
Figure 3:
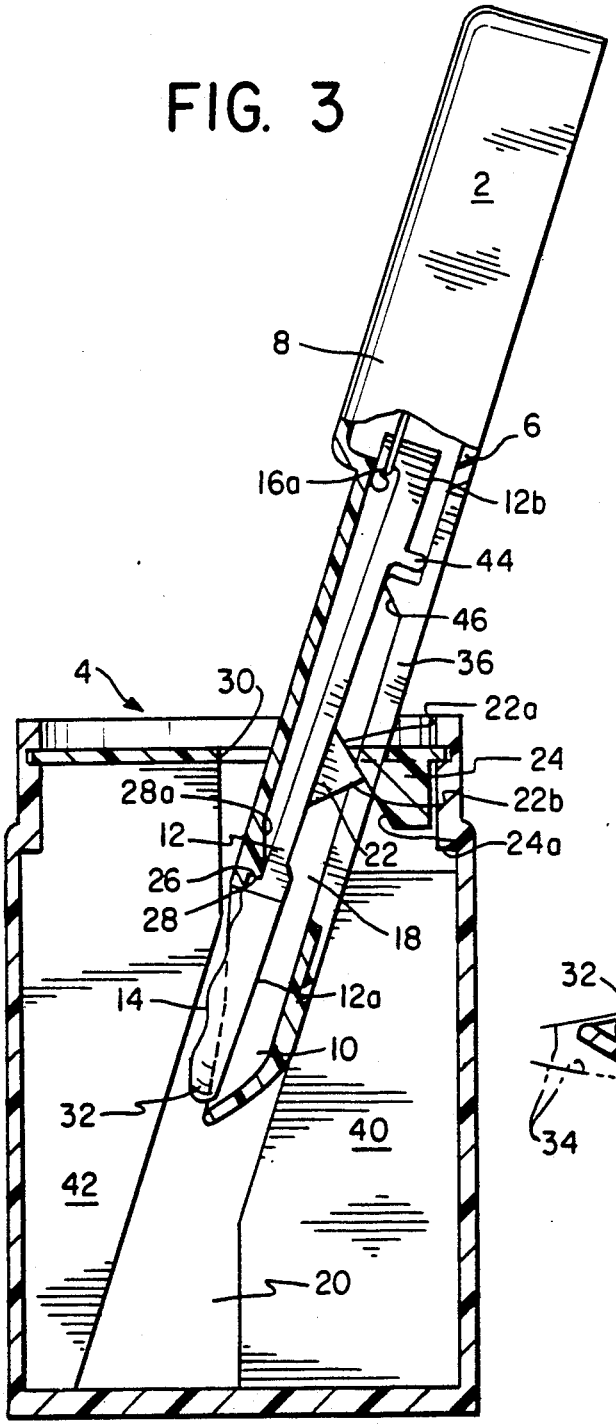
FIG. 3 is an elevational cross-section of the container and spoon of FIGS. 1 and 2 showing the relationship of the parts after the spoon has been partially withdrawn to such an extent that the imitation food is in a revealing position in the bowl of the spoon.
Figure 6:
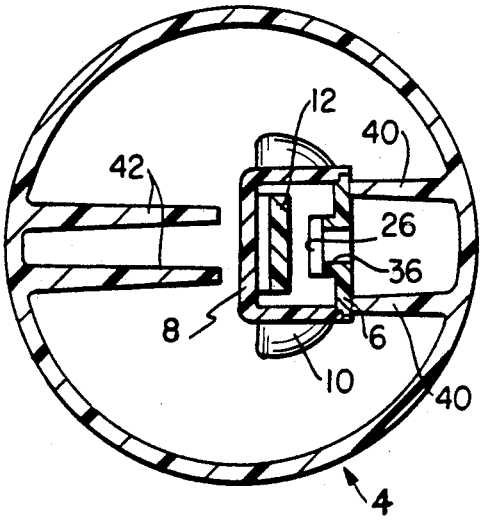
FIG. 6 is a cross-section in the direction of the arrows 6—6 of FIG. 2.

FIGS. 1-3 show progressive views of the spoon 2 being inserted and then withdrawn from the container 4. The spoon 2 has a body 6 which has the external appearance of a spoon, i.e., there is a handle 8 and a feeding end or open bowl 10. A holding element 12 has an end 12*a* with imitation food 14 and an opposite end 12*b* which is hooked and secured to an end 16*a* of a spring 16. The spring has another end 16*b* attached to a hooked element 7 from the body 6 to spring bias the holding element 12 into a hidden position, i.e., where the imitation food 14 is withdrawn from the open bowl 10 and into the hollow chamber 18 of the spoon handle 8 as shown in FIG. 1.

The hollow chamber 18 extends the length of the spoon handle 8 and is in communication with the open bowl 10. The holding element 12 is guided against moving side to side by walls of the body 6 or by internal guide walls (not shown). The ends 16*a*, 16*b* of the spring 16 wrap around a respective one of the hooked end 16 and hooked element 7 so as to keep the assembly together even under tension. Further guide walls (not shown) may be provided adjacent the spring 16 to keep the assembly from displacing apart during operation.

With the imitation food 14 in the hidden position, the spoon is inserted into the container 4 to simulate filling the open bowl 10 with food. In this case, the spoon is inserted into the guide chamber 20 within the container 4 as far as possible, that is, at least as far as necessary for the holding protrusion 22 to pass around the container projection 24. The holding protrusion 22 has slanted sides 22*a*, 22*b* to facilitate sliding for getting around the container projection 24 during insertion and subsequent withdrawal of the spoon.

The holding protrusion 22 is displaceable laterally to get around the container projection 24 and to subsequently click into a latching position to be described later. The holding element may be made of a resilient elastic material such as known plastics or metals in order to have this lateral displacement capability. Lateral displacement is to the left or right in the views of FIGS. 2 and 3. Preferably however, there is sufficient clearance provided, as shown in the drawings, to allow such displacement once the spoon is nearly fully withdrawn from the container.

During withdrawal of the spoon 2 cut of the container 4 from the fully inserted position, the holding element 12 is retained in position, relative to the container, by action of the holding protrusion 22 and container projection 24 against each other while the body 6 is being withdrawn relative to the holding element 12. Eventually, a catching end 26 of the holding element 12 is cleared by an inwardly directed latching end 28 of the body 6. The catching end 26 of the holding element 12 is preferably located adjacent the imitation food 14, between the spring 16 and the imitation food 14. During this withdrawal, the spring 16 stretches against its bias.

Upon clearing the catching end 26, the end of the holding element 12 with the imitation food 14 biases outwardly so that the latching end 28 and catching end 26 engage each other. In this position, the imitation food 14 is within the open bowl 10 and is retained there by the releasable locking engagement between the latching and catching ends 28, 26. Thus, the revealing position has been attained as shown in FIG. 3.

With the imitation food 14 locked in the revealing position, the spoon 2 is thereafter further withdrawn to be removed from the container 4. The container projection 24 also has a slanted surface 24*a* which acts against the slanted surface 22*a* of the holding protrusion 22 to facilitate withdrawal of the holding element 12. Sufficient space is provided in the vicinity of the entrance opening 30 to enable the projections 22, 24 to clear each other during the withdrawal.

Thereafter, relative movement between the body 6 and holding element 12 ceases since both move together during further withdrawal. The groove 36 continues to be slid along the container projection 24 until reaching the slanted abutment 40, at which the slanted abutment slides along the slanted surface 24*a* until clearing the same. The open bowl 10 is to some extent pushed further away from the wall 40 during the remainder of the withdrawal and into the sufficient space provided in the vicinity of the entrance opening 30. In this connection, the curvature of the end of the spoon facilitates angling of the spoon to maintain sufficient clearance between the projecting portion 32 of the imitation food 14 and the wall 42. Such clearance is needed to avoid pressing the imitation food against internal walls of the container which would cause disengagement of the latching and catching ends from each other.

FIGS. 1-3 also show a stub 44 which extends from the holding element into contact with the inside of the body 6 to help guide the holding element 12 during relative displacement of the body 6. An inwardly directed extension 46 from the body 6 may serve a similar purpose by guiding the holding element 12 during the relative displacement. FIG. 3 shows stub 44 and extension 46 practically abutting each other after the catching and latching ends 26, 28 have engaged each other into a locked position. If they abut each other, further relative displacement beyond the locking position is prevented. In other words, the extension 46 may serve as a stop to the stub 44 if necessary. Further, the extension 46 helps keep the holding element 12 in the latched condition during withdrawal of the spoon from the container by acting against the holding element 12 (see FIG. 3). In order to reach the latching position, the catching end 26 must be forced inwardly around a hump 28*a* before reaching the latching end 28.

Figure 4:
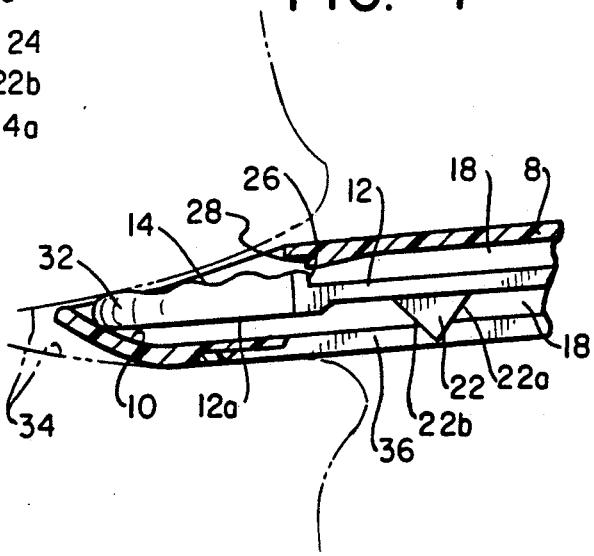
FIG. 4 is an elevational cross-section of the spoon of FIG. 3 inserted into the mouth of a doll at the instant when the imitation food dislodges from its revealing position and biases back into the hidden position in response to the walls of the mouth of the doll acting against the imitation food.

FIG. 4 shows the open bowl 10, with the imitation food in the revealing position, inserted into a doll's mouth to simulate feeding. Due to the sloping contraction of the doll's mouth inside, a portion 32 (see FIG. 3) of the imitation food 14 which projects out of the open bowl 10 is pressed toward the base of the open bowl 10 by and between the converging sloping walls 34 of the doll's mouth. The pressing of the portion 32 causes the catching end 26 of the imitation food 14 to disengage from the latching end 28 of the spoon body 6. Since the holding element 12 is spring biased, the imitation food 14 is withdrawn into the hidden position within the hollow chamber 18 of the spoon handle 8 when released from engagement. For even greater realism, a damper may be provided (not shown) to damper the bias action of the spring 16. This will allow the holding element to be pulled back more slowly than if the spring were acting by itself. Many dampers are available, such as, a damper of the dash-pot type in which a small piston in a cylinder cooperates with an air vent of appropriate size.

Figure 5:
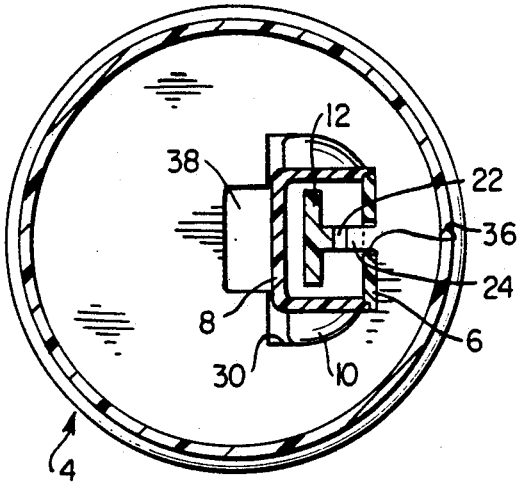
FIG. 5 is a cross-section in the direction of the arrows 5—5 of FIG. 2.

It can be seen from FIG. 5 that the top of the container 4 has the entrance opening 30 configured to the shape of the spoon 2 so as to ensure that the spoon 2 can be inserted into the container 4 in only one possible manner. During insertion and withdrawal, a groove 36 in the underside of the spoon 2 accommodates the container projection 24 therein to guide the spoon 2 during its sliding insertion and withdrawal to and from the channel 20.

The opening 30 also has a portion 38 for accommodating withdrawal of the portion 32 of the imitation food 14 that projects out of the open bowl 10. This is done to avoid having the portion 32 pressed against the edge of the entrance opening 30 during withdrawal. The reason the groove 36 does not extend into the open bowl 10 is for aesthetic reasons; when the imitation food 14 is in the hidden position, the open bowl 10 is visible and so should appear to be the same as that of a normal spoon, which has no groove in it.

FIG. 5 shows the guide walls 40, 42 acting against the housing 6 for effecting guiding of the same in the channel 20. The end face of each pair of guide walls 40, 42 are parallel to each other. The container 4 is manufactured by being molded into two halves and then joined together and may be made from a plastic or metal material.

Although a spoon 2 is disclosed as the preferred embodiment, any other utensil, such as a fork, may be used instead so as to replace the open bowl 10 by the characteristic end of the utensil, such as prongs of the fork. By imitation food, both solid and liquid forms are envisioned (the liquid form would be held within a transparent pouch). The container may resemble cans, bottles or other types of containers known to carry food and/or liquid; preferably the exterior walls are opaque to prevent the child who is using the feeding apparatus from seeing what goes on inside the container.

The catching end 26 and latching end 28 may be any type of engageable components as long as they engage each other when the revealing position has been attained and are disengageable from each other when inserted into a doll's mouth. While the holding element 12 preferably biases into the hidden position and latches into the revealing position as described, an alternate embodiment would operate in an opposite manner, i.e., the spring biases the holding element 12 into the revealing position and the holding element 12 latches into the hidden position to cause the spring to compress.

While the foregoing description and drawings represent the preferred embodiments of the present invention, it will be understood that various changes and modifications may be made without departing from the spirit and scope of the present invention.

What is claimed is:

1. Apparatus useful for simulating feeding of food to a mouth of a baby doll, comprising:

a toy utensil having a body with feeding end and a hollow handle extending from the feeding end;

an elongated holding element having two ends including a first end portion decorated to simulate food and a second end portion, said holding element being displaceable between a hidden position in which said first end portion is concealed within the hollow handle and a revealing position in which said first end portion is revealed by projecting over said feeding end of the utensil;

means for biasing said holding element into one of the hidden and revealing positions, said biasing means being secured to said second end portion; and latch means for releasably securing said holding element into the other of the hidden and revealing positions and for thereafter allowing said holding element, under the urging of said bias means, to move to the one of the hidden and revealing positions in response to release of said latch means.

2. An apparatus as in claim 1, further comprising:

a container having an opening through which the toy utensil with the holding element may be inserted and withdrawn manually, said latch means including an engageable latch and catch, said latch extending from said body, said catch extending from said holding element; and blocking means on said container for blocking said holding element from displacing through the opening together with said body during withdrawal until said latch and catch engage each other within the container, said latch and catch engaging each other within the container after the body displaces relative to the holding element so that the first end portion reaches the revealing position during the withdrawal because of said blocking means, said latch biasing into engagement with said catch when the first end portion reaches said revealing position.

3. An apparatus as in claim 2, wherein the latch disengages from the catch in response to pressure being applied to said first end portion of said holding element in a direction transverse to the direction in which said holding element is displaceable, said first end portion being pulled by the biasing means into the one of the hidden and revealing positions when the latch disengages from the catch.

4. An apparatus as in claim 2, further comprising guiding means in said container and on said body for guiding the body during the insertion and withdrawal through said opening so that the insertion and withdrawal is effected in substantially the same way every time.

5. An apparatus as in claim 4, wherein said guiding means includes a guide channel in the body, said blocking means including a projection on said container which extends into the guide channel during withdrawal and insertion of the utensil from the container, said blocking means also including a protrusion extending from said holding element which engages said projection during the blocking.

6. An apparatus as in claim 1, further comprising:

a mouth of a doll defined by a pair of upper and lower walls which converge toward each other toward the interior of the mouth, said first end portion of said holding element having a projecting portion which projects out of the feeding end of the body when said holding element is in said revealing position so that the latch means disengages in response to said projecting portion becoming pressed transversely to the direction of displacement of said holding element, by engagement with the upper wall of the mouth during insertion of said feeding end between the upper and lower walls, said biasing means urging said holding element to displace from the revealing position to the hidden position thereof in response to disengagement of said latch means.

7. An apparatus as in claim 1 wherein said biasing means is a coil spring secured between said holding element and said hollow handle.

8. An apparatus as in claim 1 wherein said biasing means biases the holding element into the hidden position.

9. An apparatus as in claim 1, wherein the body is in a form of a spoon, the feeding end having a shape of an open bowl, the first end portion of the holding element which is decorated to simulate food being displaceable between a position which is over the open bowl and a position which is out of the open bowl.

10. An apparatus as in claim 4, further comprising guide walls within said container, the body being guided between the guide walls during the displacement of the body relative to the holding element so that during withdrawal of the toy utensil from the container the toy utensil may reach a relative position in the container where said latch means secures the holding element.

* * * * *

UNITED STATES PATENT AND TRADEMARK OFFICE

CERTIFICATE OF CORRECTION

PATENT NO. : 5,118,321

DATED : June 2, 1992

INVENTOR(S) : Lawrence J. Greenberg et al.

It is certified that error appears in the above-identified patent and that said Letters Patent is hereby corrected as shown below:

In the Title page, at Section "[75] Inventors:", delete "Lawrence J. Greenberg, New Rochelle; Gregory E. Hyman, Pound Ridge; Judith H. Blau, Eastchester, all of N.Y." and substitute therefor --Lawrence J. Greenberg, New Rochelle, N.Y.; Gregory E. Hyman, Pound Ridge, N.Y.; Judith H. Blau, Eastchester, N.Y.; and Michele P. Trammell, Williamsburg, Ohio--.

Signed and Sealed this

Nineteenth Day of October, 1993

Bruce Lehman

*Attest:*

BRUCE LEHMAN

*Attesting Officer*

*Commissioner of Patents and Trademarks*